United States Patent [19]

Bernard

[11] 3,941,418

[45] Mar. 2, 1976

[54] UPHOLSTERED SEAT

[75] Inventor: Charles Bernard, Paris, France

[73] Assignee: Airborne, S.A., Montreuil, France

[22] Filed: Dec. 26, 1974

[21] Appl. No.: 536,382

[30] Foreign Application Priority Data

Jan. 8, 1974 France ..... 74.00525

[52] U.S. Cl. ..... 297/355; 297/456; 297/DIG. 1; 297/DIG. 2

[51] Int. Cl.[2] ..... B60N 1/02

[58] Field of Search ..... 297/455, 456, DIG. 1, 354, 297/355, DIG. 2, 219, 229; 5/334 C, 335

[56] References Cited

UNITED STATES PATENTS

| | | | |
|---|---|---|---|
| 2,469,084 | 5/1949 | Schenker | 5/345 X |
| 3,289,224 | 12/1966 | Witchell | 297/DIG. 1 |
| 3,636,575 | 1/1972 | Smith | 5/334 C |

*Primary Examiner*—James C. Mitchell
*Attorney, Agent, or Firm*—Burgess, Ryan and Wayne

[57] ABSTRACT

An upholstered seat comprises a supporting structure constituted by rigid elements and embedded entirely in a mass of elastic plastic material which constitutes the upholstering of said seat.

7 Claims, 9 Drawing Figures

UPHOLSTERED SEAT

The instant invention is related to an upholstered seat, and, more particularly, to a adjustable upholstered seat which is comfortable and which presents a high flexibility in use.

Many known adjustable seats of this kind are provided with pivotal or similar connections and/or structural elements which are not satisfactory from an aesthetic point of view.

The instant invention is consequently aimed at providing an upholstered seat presenting a particularly sober design.

In accordance with one object of the present invention an upholstered seat comprises a supporting structure constituted by a plurality of rigid structural elements, wherein said elements are entirely embedded in a mass of elastic plastic material, which material preferably constitutes the upholstering of said seat.

It is also an object of the present invention to provide an upholstered adjustable seat which is constituted by at least two sections pivotally connected to each other and adapted to be placed selectively into a plurality of predetermined positions wherein said seat presents, correspondingly, a plurality of different configurations, the said mass of plastic material constituting the upholstering of the seat and being adapted to be deformed when said pivotally connected sections are brought from one of said predetermined positions into another one of said positions.

It is another object of the instant invention to provide an upholstered adjustable seat wherein said mass of plastic material presents the general configuration of a comparatively thick elongated mat, while said sections constituted by rigid structural elements are pivotally connected to each other in such a way that they are enabled to effect relative angular displacements about at least one folding axis which is transverse with respect to said elongated mat.

It is a further object of the present invention to provide an upholstered adjustable seal wherein the abovementioned supporting structure preferably comprises a substantially rectangular frame and wherein the said folding lines are parallel to the shorter sides of the rectangle defined by said frame.

The seat according to the instant invention is advantageous as its construction is particularly simple, its manufacturing cost is very low, and the cost involved when shipping said seat is also extremely low on account of the reduced volume of the novel seat.

These and other features and advantages of the instant invention will become apparent from the description herein-below which is related to the appended drawings and given by way of example, but not of limitation of the scope of the instant invention.

FIG. 1 schematically shows one end portion of a seat according to the instant invention, said Figure illustrating a portion of the supporting structure of said seat from which the mass of plastic material wherein said portion is normally embedded has been removed; this Figure also shows a portion of the covering sheet surrounding said plastic material.

FIG. 2 shows one embodiment of the supporting structure of the seat according to the invention.

FIGS. 3*a* and 3*b* show one position of said supporting structure, when the seat is being used, the volume occupied by the mass of plastic material constituting the upholstering of the seat being indicated by a dashed line; more particularly, FIG. 3*a* shows the seat in its unloaded position, while FIG. 3*b* shows the seat when supporting the weight of a user.

Figure 1:
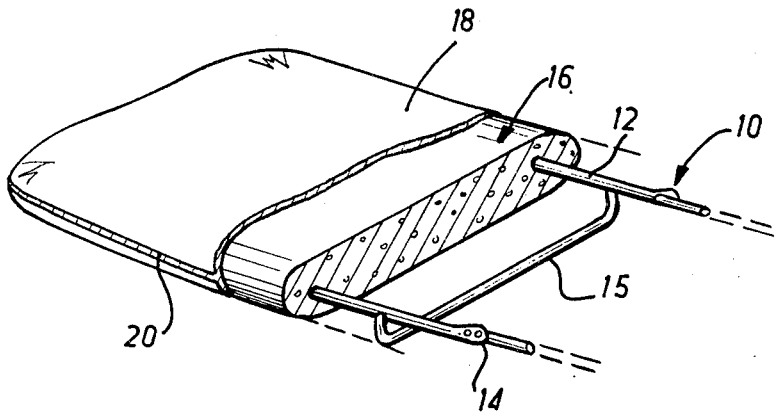

As illustrated in FIG. 1 the seat according to the invention comprises a supporting structure 10 constituted by metal tubes 12 which are arranged to form a frame, said tubes being provided at certain locations with articulation elements such as shown at 14. This supporting structure may comprise support members 15, and it is embedded in a mass of plastic material 16 of a conventional preferably elastic nature, for example a plastic material of the polyether type or a plastic material of the type known under the commercial designation of "Dacron." In the embodiment shown, the mass of plastic material which may have any convenient configuration is surrounded by a covering 18. Advantageously, this covering 18 has a slit 20 extending over a portion or the entirety of its periphery so as to enable the user to extract the mass of plastic material from said covering, this slit being advantageously provided with closing means, such as a zip fastener, which normally maintains the edges of the slit in a juxtaposed position.

Figure 2:
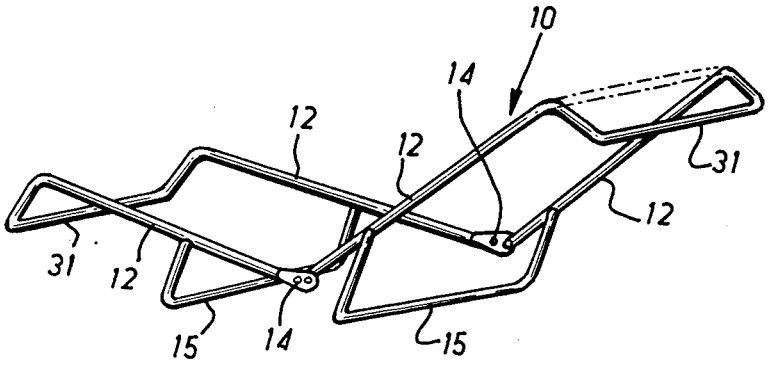

Supporting structure 10 may have any convenient configuration. FIG. 2 shows one embodiment wherein said supporting structure has the form of a frame constituted by bent metallic tubes, said structure having the general configuration of an elongated rectangle. An articulation element 14 is arranged in the central region of each one of the tubes constituting the respective long sides of said rectangle. Thus the frame may be folded about a transverse line which is parallel to the smaller sides of the rectangle defined by the frame. Said frame comprises two supporting elements 15 constituted by hoop members the respective ends of which are attached, e.g. by welding, to the tubes 12 constituting the long sides of the rectangular frame.

Figure 3A:
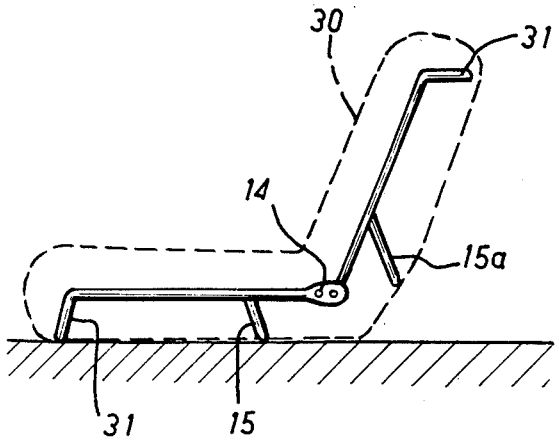
Figure 3B:
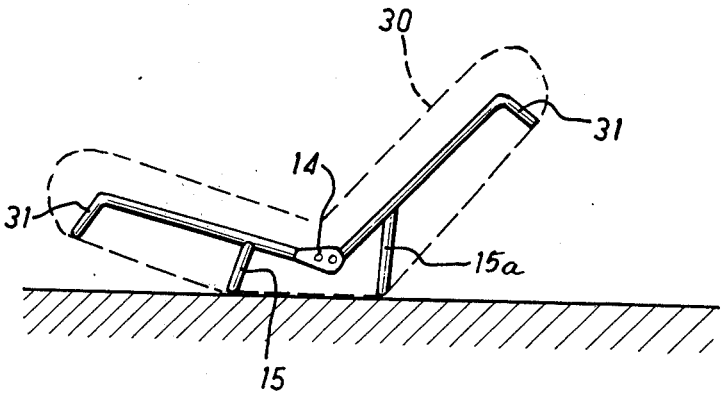
Figure 4:
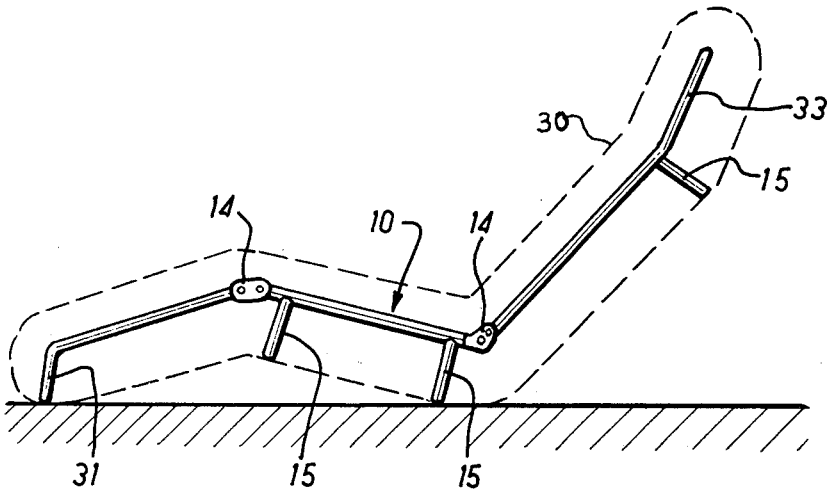
FIG. 4 illustrates another embodiment of the supporting structure of the seat according to the invention.
Figure 5:
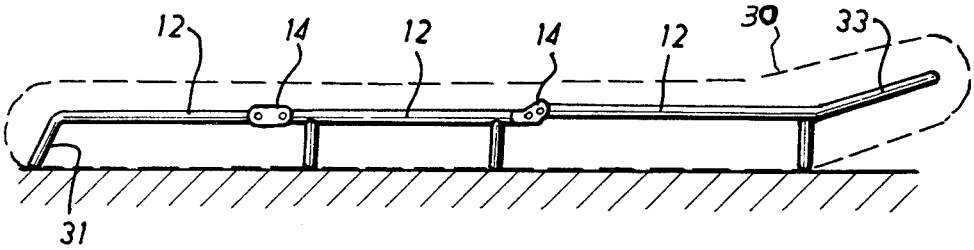
FIG. 5 is a view similar to that of FIG. 3 and shows the same supporting structure.

The supporting structure is embedded in a mass of elastic plastic material the contour of which is illustrated by a dashed line 30 in FIGS. 3a and 3b. As shown in the Figures, the outer surface of said mass of plastic material is flush with the free ends of the supporting members 15. Articulation elements 14 advantageously are of a construction which allows to vary the angle formed between the two sections of the supporting structure. The two ends of the frame may be bent as shown, for instance, at 31, thus constituting complementary supporting members.

In this embodiment one supporting member 15*a* is attached to the section of the frame which constitutes the back of the seat. This member 15*a* is in a position above the ground when the seat is empty; in this position said seat rests on the supporting members 15 and 31 arranged underneath the main section of the seat (cf. FIG. 3*a*).

When a user is sitting on the seat, the latter will effect a pivotal movement which is rearwardly directed; this pivotal movement is taking place progressively under the effect of the progressive squeezing of the mass of plastic material, and it is pursued until the supporting member 15a engages the ground (cf. FIG. 3*b*).

When the user leaves the seat, the latter will come back to its initial position as shown in FIG. 3*a*, on account of the inherent elasticity of the mass of plastic material.

FIGS. 4 to 8 shows another embodiment of the seat according to the invention. The supporting structure 10 of this embodiment also has a generally rectangular configuration, however, each one of the tubes constituting the long sides of the rectangular frame has two articulation elements 14. Furthermore, the frame is provided with supporting members 15; one of the ends of said frame is bent as shown at 31, so as to constitute a complementary supporting member, while the other end of said frame is bent as shown at 33.

As in the preceding embodiment the supporting structure is embedded in a mass of elastic plastic material, the contour of which is indicated by a dashed line at 30.

The frame constituting the supporting structure may be placed in a substantially flat position (cf. FIG. 5), in which case the seat according to the invention defines a surface enabling the user to lay down and rests on supporting members 15 and 31 the respective ends of which are flush with the adjacent surface of plastic material.

Figure 6:
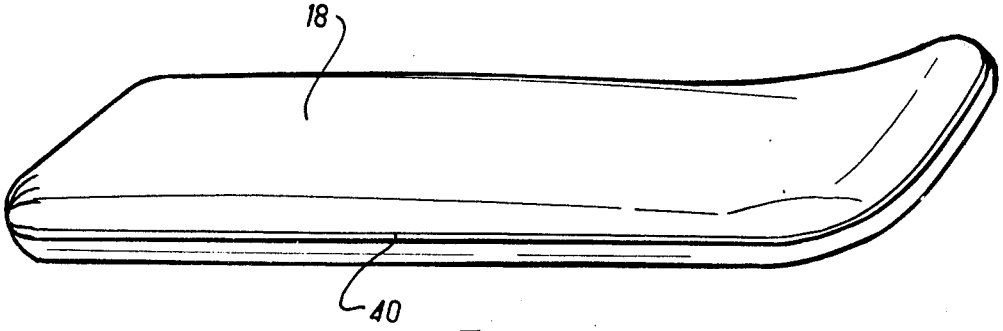
FIGS. 6, 7 and 8 illustrate schematically the seat of FIGS. 4 and 5 in three possible positions of said seat when the latter is being used.
Figure 7:
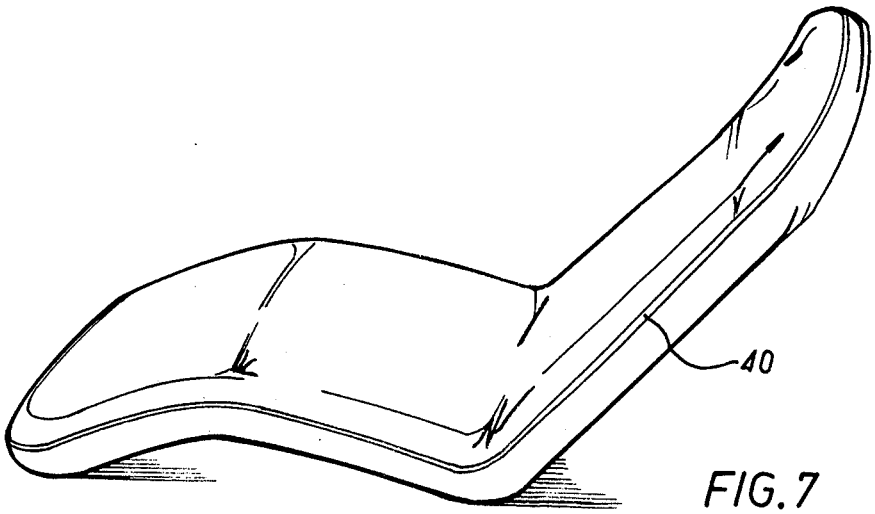
Figure 8:
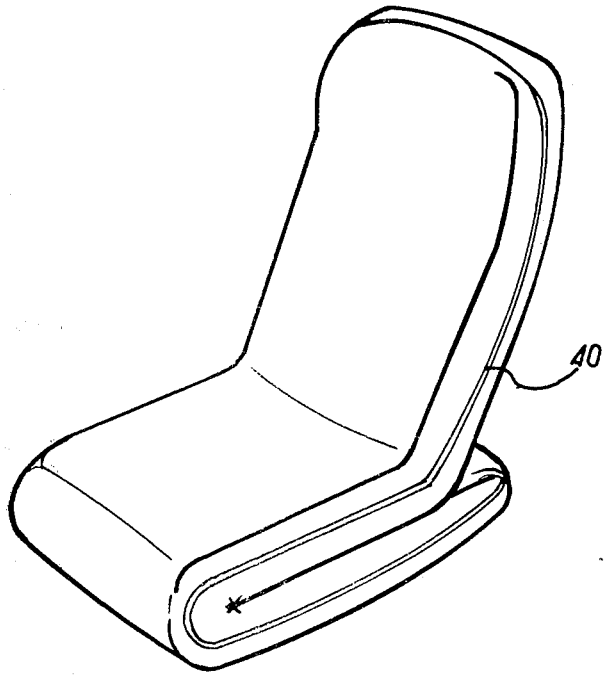

FIGS. 6 to 8 show various positions of the seat according to this embodiment of the invention. FIG. 6 shows the seat in a "lying" position; FIG. 7 shows the seat in a "relax" position, and FIG. 8 illustrates the "low chair" position of the seat.

The covering 18 constitutes a pocket open at one of its sides, the opening of said covering being provided, for instance, with a zip fastener 14.

A plurality of seats according to the instant invention may provide a group of modular units, due to the various positions into which every seat may be brought by folding. Each one of such seats may, of course, constitute an emergency bed. It is particularly advantageous to provide a seat according to the invention with a replaceable covering.

What is claimed is:

1. An upholstered seat comprising a mass of elastic plastic material having a top surface adapted to receive thereon portions of a user's body, and a bottom surface opposite said top surface, said seat further comprising a supporting structure including a plurality of rigid structural elements which are pivotally connected to each other, at least one supporting element adapted to support said seat on the ground, and being rigidly attached to at least one of said rigid structural elements, said supporting structure and said supporting element attached thereto being entirely embedded within said plastic material mass in such a manner that the free ends of said supporting element are substantially flush with said bottom surface of said plastic material mass.

2. An upholstered seat according to claim 1, comprising a plurality of additional supporting elements at least some of which are constituted by hoop-shaped elements, said supporting structure being a substantially rectangular frame structure having short sides and long sides constituted by at least two frame sections which comprise each two parallel longitudinal frame portions pivotally connected to each other so as to be angularly displaceable relative to each other about a line parallel to the short sides of said rectangular frame structure, each one of said hoops being so arranged that it rigidly connects the long sides of said rectangular frame structure along a line parallel to said short sides thereof.

3. An upholstered seat according to claim 1, wherein said supporting structure comprises pivotally connected frame sections forming a substantially rectangular frame structure, and wherein at least one end of the latter is bent to form a frame end portion extending towards said bottom surface of said plastic material mass, and thus to constitute a supplementary supporting element for supporting said seat on the ground.

4. An upholstered seat according to claim 1, wherein said supporting structure is substantially constituted by tubular elements.

5. The seat of claim 1, wherein said mass of elastic plastic material is arranged within a covering.

6. A seat according to claim 1, wherein said plastic material mass is arranged within a covering provided with a slit enabling said mass of plastic material to be withdrawn from said covering, said covering further comprising means for maintaining the edges of said slit in a juxtaposed position.

7. The seat of claim 1, wherein said mass of elastic plastic material is arranged within a covering provided with a slit enabling said mass of plastic material to be withdrawn from said covering, the latter further comprising means for maintaining the edges of said slit in a juxtaposed position, and said slit extending substantially over the entire periphery of said covering.

* * * * *